US008123380B2

(12) United States Patent
Liao

(10) Patent No.: US 8,123,380 B2
(45) Date of Patent: Feb. 28, 2012

(54) WATERPROOF LIGHT-EMITTING-DIODE LAMP HOLDING STRUCTURE

(76) Inventor: Hsu-Wen Liao, Pingjhen (TW)

( * ) Notice: Subject to any disclaimer, the term of this patent is extended or adjusted under 35 U.S.C. 154(b) by 313 days.

(21) Appl. No.: 12/541,573

(22) Filed: Aug. 14, 2009

(65) Prior Publication Data

US 2011/0038155 A1 Feb. 17, 2011

(51) Int. Cl.
*F21V 29/00* (2006.01)

(52) U.S. Cl. ..... 362/267; 362/249.02; 362/249.06; 362/158; 362/311.02; 362/800

(58) Field of Classification Search ..... 362/158, 362/227, 234, 249.01–249.02, 249.06, 249.14, 362/249.16, 253, 267, 311.01–311.02, 800, 362/806; 40/550, 551
See application file for complete search history.

(56) References Cited

U.S. PATENT DOCUMENTS 7,100,624 B2 * 9/2006 Lee ..... 135/16
7,244,044 B2 7/2007 Liao

* cited by examiner

*Primary Examiner* — Stephen F Husar
*Assistant Examiner* — Meghan Dunwiddie
(74) *Attorney, Agent, or Firm* — Muncy, Geissler, Olds & Lowe, PLLC

(57) ABSTRACT

A waterproof LED lamp holding structure includes an object having a plurality of through holes, and a plurality of LED lamps serially connected via an electric wire. Each of the LED lamps has a rear part enclosed in a protective member that has a first and a second end. Wedge-like keys are provided on the protective member near the first end and each have a rearward outward slant outer surface. Further, anchoring lugs are provided on the protective member to outward obliquely extend from the second end toward the first end. When the LED lamps along with the protective members are inserted in the through holes on the object, the wedge-like keys and distal ends of the anchoring lugs respectively abut against an outer and an inner side of the object to thereby hold the LED lamps immovable and straight in the through holes.

11 Claims, 7 Drawing Sheets

WATERPROOF LIGHT-EMITTING-DIODE LAMP HOLDING STRUCTURE

FIELD OF THE INVENTION

The present invention relates generally to a waterproof light-emitting-diode (LED) lamp holding structure, and more particularly to a waterproof LED lamp holding structure with which a plurality of serially connected LED lamps can be held immovable and straight in through holes formed on an object, which can be a signboard, an LED illuminator, or a decorative lighting fixture.

BACKGROUND OF THE INVENTION

Please refer to FIG. 1 that is an exploded perspective view of a waterproof LED illuminating device disclosed in U.S. Pat. No. 7,244,044 granted to the same applicant of the present invention, and to FIG. 2 that is a perspective view of an LED lamp for the waterproof LED illuminating device of FIG. 1. The waterproof LED illuminating device includes an object 10 and an LED lamp bank composed of a plurality of LED lamps 20 serially connected via an electric wire 21. The object 10 is provided with a plurality of through holes 11, and can be a signboard, an LED illuminator or a decorative lighting fixture.

Each of the LED lamps 20 is inserted in one of the through holes 11 on the object 10, and includes an LED 22 and a protective member 23 enclosing a rear part of the LED 22 and the electric wire 21 connected to contact pins of the LED 22, so that the LED 22 and the electric wire 21 are protected against water and the problem of power failure.

Referring to FIG. 2, the protective member 23 has a first end 231 and a second end 232. The LED 22 is forward projected from the first end 231 of the protective member 23. The first end 231 has an end face area smaller than that of the second end 232. In addition, the protective member 23 is wasted. That is, the protective member 23 has a radially inward curved peripheral wall 233, allowing easy insertion of the protective member 23 into the through hole 11 on the object 10.

LED has the advantages of lower cost, less power consumption, and longer usable life compared to the conventional lamps, and can therefore be advantageously used to make signboards, LED illuminators or decorative lighting fixture at low cost. LEDs on the signboard can be arranged to show proper graphic patterns or characters. Moreover, LEDs can be reused when the signboard is changed in design. Therefore, signboards with LEDs are widely adopted among commercial and industrial fields.

However, the LED emits straight light in one direction. In the case of having a large number of LED lamps separately inserted in the through holes on the object, light emitted from any biased LED lamp will show different brightness on the object. That is, the LED lamps being correctly mounted in the through holes on the object are brighter while the LED lamps being angularly mounted in the through holes on the object are darker when viewing from outside of the object. While an auxiliary reflective or refractive hood can be added to the LED lamp to achieve improved uniformity of brightness, such hood will also bring increased manufacturing cost and complicated manufacturing process to the LED lamp.

It is therefore tried by the inventor to develop an improved waterproof LED lamp holding structure, so that all the LED lamps are held immovable and straight in the through holes on an object.

SUMMARY OF THE INVENTION

A primary object of the present invention is to provide a waterproof LED lamp holding structure that allows easy, quick and waterproof mounting of a plurality of serially connected LED lamps to a signboard, an LED illuminator or a decorative lighting fixture at low cost to show colorful changes.

Another object of the present invention is to provide a waterproof LED lamp holding structure with which a plurality of serially connected LED lamps can be separately held immovable and straight in through holes formed on an object without the risk of becoming biased due to external force, so that the LED lamps on the object show uniform brightness.

To achieve the above and other objects, the waterproof LED lamp holding structure according to the present invention includes an object having an outer and an inner side, and a plurality of LED lamps serially connected via an electric wire. Each of the LED lamps has a rear part enclosed in a protective member, which shields junctions of contact pins and the electric wire against external environment, and has a first and a second end. Wedge-like keys are provided on an outer face of the protective member near the first end and each have a rearward and outward increasing thickness to define a slant outer surface. Further, anchoring lugs are provided on the outer face of the protective member to outward obliquely extend from the second end toward the first end. When the LED lamps along with the protective members are inserted in the through holes on the object, the wedge-like keys and distal ends of the anchoring lugs respectively abut against the outer and the inner side of the object to thereby hold the LED lamps immovable and straight in the through holes.

In an embodiment of the present invention, the protective member has two diametrically opposite and symmetrical anchoring lugs and the distal ends of the anchoring lugs are T-shaped.

In another embodiment of the present invention, the protective member has two diametrically opposite and symmetrical anchoring lugs and the anchoring lugs each have a width gradually increasing toward the first end of the protective member.

In a further embodiment of the present invention, the protective member has two diametrically opposite and symmetrical anchoring lugs and the distal ends of the anchoring lugs are V-shaped.

In a still further embodiment of the present invention, the protective member has three equally spaced anchoring lugs to look like having three claws.

In a still further embodiment of the waterproof LED lamp holding structure, the anchoring lugs of the protective member are elastic and have a length sufficient for the distal ends of the anchoring lugs to elastically bend and flatly press against the inner side of the object when the wedge-like keys of the protective member have fully passed the through hole to abut on the outer side of the object.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments and with reference to the accompanying drawings. It is understood the embodiments and the accompanying drawings are provided only for exemplification and not intended in any way to restrict the present invention.

Figure 1:
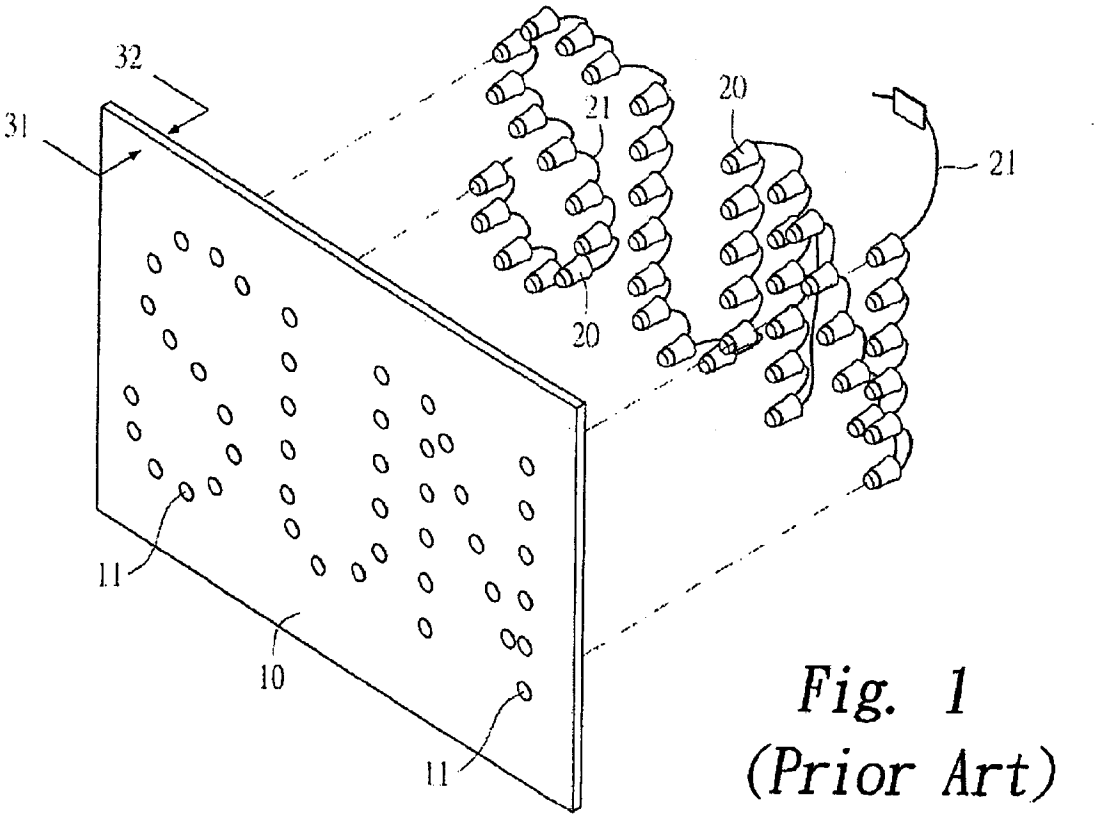
Fig. 1 (Prior Art)
FIG. 1 is an exploded perspective view of a waterproof LED illuminating device according to an embodiment of U.S. Pat. No. 7,244,044.
Figure 2:
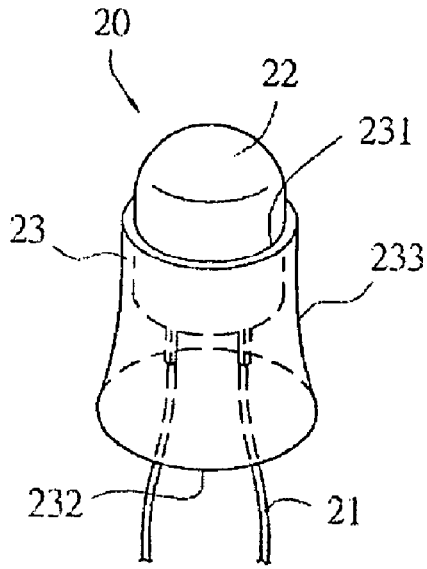
Fig. 2 (Prior Art)
FIG. 2 is a perspective view of one single LED lamp forming the waterproof LED illuminating device according to U.S. Pat. No. 7,244,044.

The present invention provides a waterproof LED lamp holding structure that has an overall structure generally similar to that shown in FIG. 1, and includes an object 10 and a lamp bank composed of a plurality of light-emitting-diode (LED) lamps 20. The object 10 can be a signboard, an LED illuminator or a decorative lighting fixture having a regular or an irregular configuration, including but not limited to a bar-shaped object, a designed character, a designed pattern, a spherical object, a flat plate and the like. The object 10 has an outer side 31 and an inner side 32 (see FIGS. 4 and 5), and is provided with a plurality of through holes 11, which can be arranged to show geometrical patterns or characters. The LED lamps 20 are serially connected via an electric wire 21 to form the lamp bank. Each of the LED lamps 20 has a light-emitting section and a contact pin section. A protective member 23 encloses a rear part of the LED lamp 20 to shield a junction of the contact pin section and the electric wire 21. The LED lamp 20 is inserted into the through hole 11 from the inner side 32 toward the outer side 32 of the object 10 and is held in the through hole 11 via the protective member 23, such that the light-emitting section of the LED lamp 20 is forward projected from the outer side 31 of the object 10.

The present invention is provided mainly to improve the structure of the protective member 23 for the LED lamp 20, so that the LED lamp 20 can be held immovable and straight in the through hole 11 via the protective member 23. Please refer to FIG. 3, which is a perspective view of an LED lamp 20 for the waterproof LED lamp holding structure according to a first embodiment of the present invention. In the first embodiment of the present invention, the protective member 23 has a first end 231 closer to the light-emitting section of the LED lamp 20 and a second end 232 opposite to the first end 231. The light-emitting section of the LED lamp 20 forward projecting from an end face of the first end 231 of the protective member 23 and the electric wire 21 rearward extending out of an end face of the second end 232 of the protective member 23.

Preferably, the protective member 23 is made of an elastic PVC material and in the form of a substantially cylindrical body. The first end 231 has a cross-sectional area smaller than that of the second end 232, making the protective member 23 looked like a truncated cone. The through hole 11 of the object 10 has a size larger than the cross-sectional area of the first end 231 but smaller than the cross-sectional area of the second end 232 of the protective member 23, advantageously allowing the protective member 23 and the LED lamp 20 to move through the through holes 11 from the inner side 32 toward the outer side 31 of the object 10 and be finally held in the through hole 11 with the light-emitting section of the LED lamp 20 forward projected from the outer side 31 of the object 10.

Figure 3:
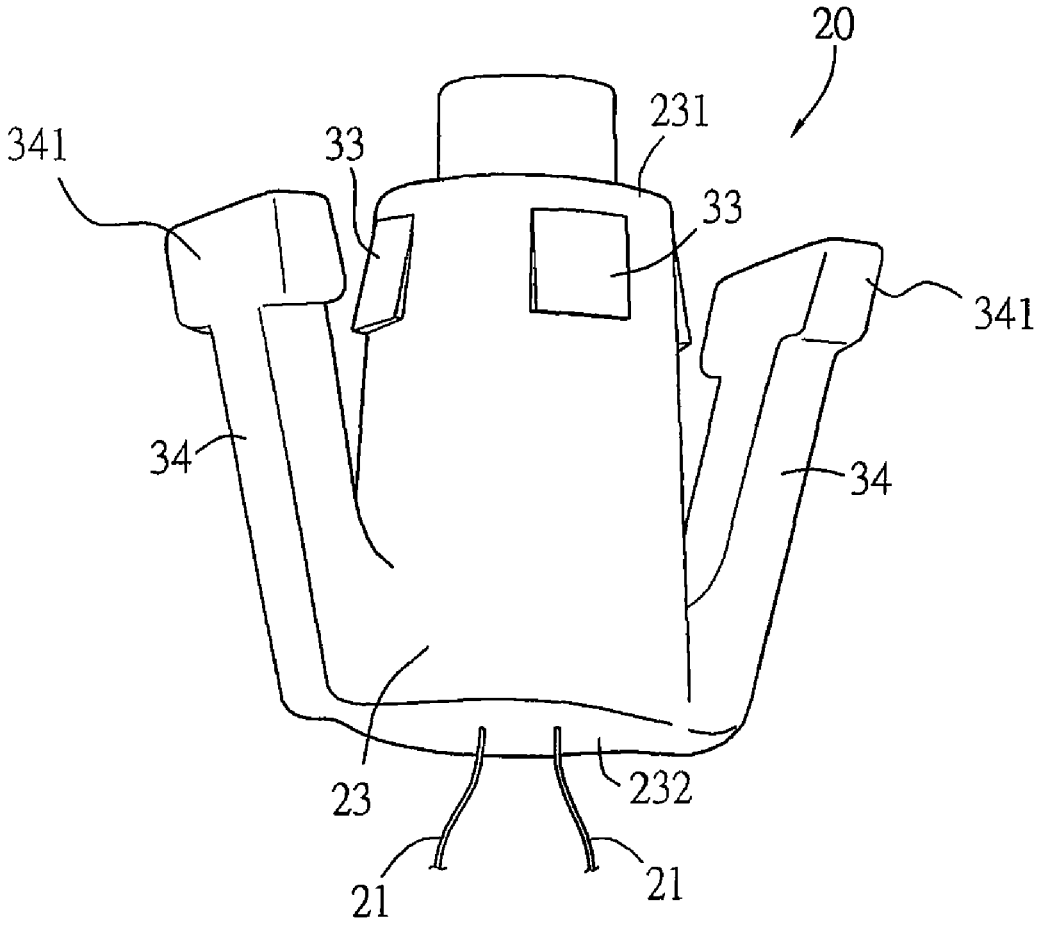
FIG. 3 is a perspective view showing an LED lamp for the waterproof LED lamp holding structure according to a first embodiment of the present invention.
Figure 4:
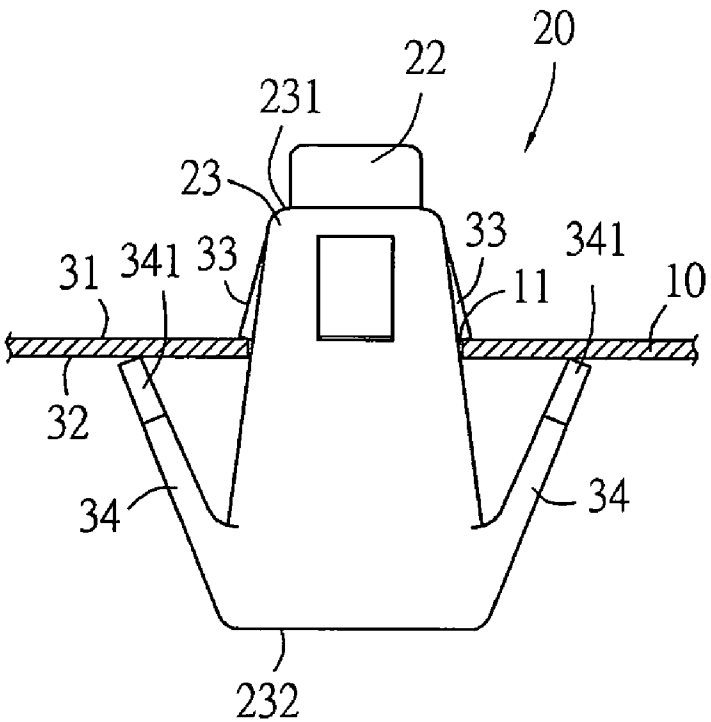
FIG. 4 is a fragmentary sectioned side view of the waterproof LED lamp holding structure according to the first embodiment of the present invention showing the LED lamp of FIG. 3 is inserted in a through hole provided on an object.

FIG. 4 is a fragmentary sectioned side view showing the LED lamp 20 of FIG. 3 is held in the through hole 11 on the object 10 via the protective member 23. Please refer to FIGS. 3 and 4 at the same time. The protective member 23 is provided on an outer face near the first end 231 with a plurality of wedge-like keys 33, each of which is extended from near the first end 231 toward the second end 232 with the thickness of the wedge-like key 33 gradually increasing toward the second end 232 to define a slant outer surface for smoothly guiding the protective member 23 and accordingly the LED lamp 20 into and through the through hole 11 on the object 10. After having completely passed through the through hole 11 on the object 10, the wedge-like keys 33 will abut against the outer side 31 of the object 10 to stop the protective member 23 from rearward moving out of the through hole 11.

The protective member 23 is further provided on the outer face near the second end 232 with a plurality of anchoring lugs 34. The anchoring lugs 34 are outwardly obliquely extended from near the second end 232 toward the first end 231, making the protective member 23 looked like an anchor for ships. When the protective member 23 is held in the through hole 11 by the wedge-like keys 33 abutted on the outer side 31 of the object 10, distal ends 341 of the anchoring lugs 34 are also abutted against the inner side 32 of the object 10. With the wedge-like keys 33 and the anchoring lugs 34 abutted against the outer and the inner side 31, 32 of the object 10, respectively, the LED lamp 20 along with the protective member 23 can be held immovable and straight in the through hole 11 on the object 10 without the risk of becoming biased due to an external force.

Preferably, the protective member 23 has two diametrically opposite and symmetric anchoring lugs 34, as shown in FIGS. 3 and 4. In the first embodiment of the present invention, the distal ends 341 of the anchoring lugs 34 are T-shaped, and the anchoring lugs 34 each have an overall length that allows the distal ends 341 of the anchoring lugs 34 to fitly touch and abut on the inner side 32 of the object 10.

Figure 5:
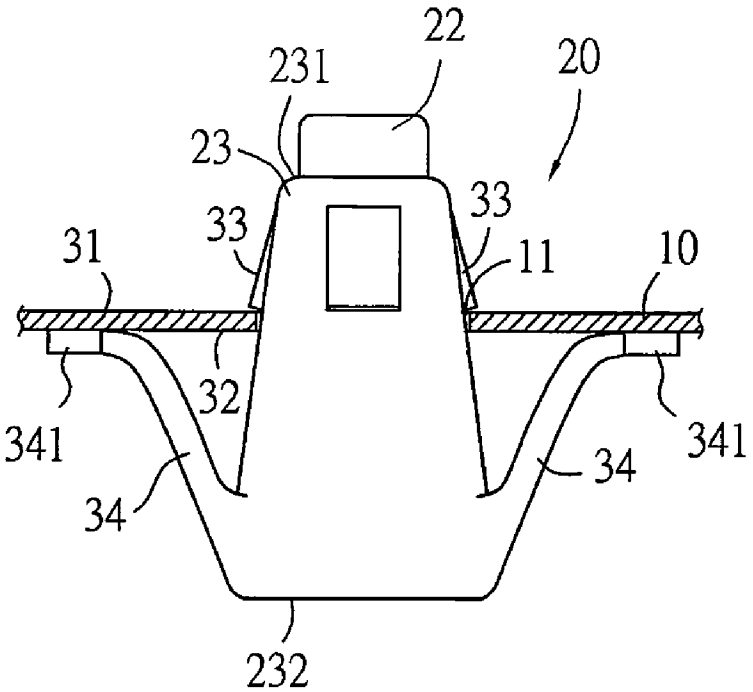
FIG. 5 is a fragmentary sectioned side view of a waterproof LED lamp holding structure according to of a second embodiment of the present invention.

Since the protective member 23 is made of an elastic PVC material, the anchoring lugs 34 integrally provided on the protective member 23 are also elastic. Therefore, in a second embodiment of the present invention as shown in FIG. 5, the anchoring lugs 34 are designed to have an increased length compared to the first embodiment. As can be seen in FIG. 5, which is a fragmentary sectioned side view, the distal ends of the length increased anchoring lugs 34 are elastically bent to flatly press against the inner side 32 of the object 10 when the wedge-like keys 33 of the protective member 23 have fully passed the through hole 11 to abut on the outer side 31 of the object 10. In this manner, the LED lamp 20 is more firmly held in the through hole 11 on the object 10.

Figure 6:
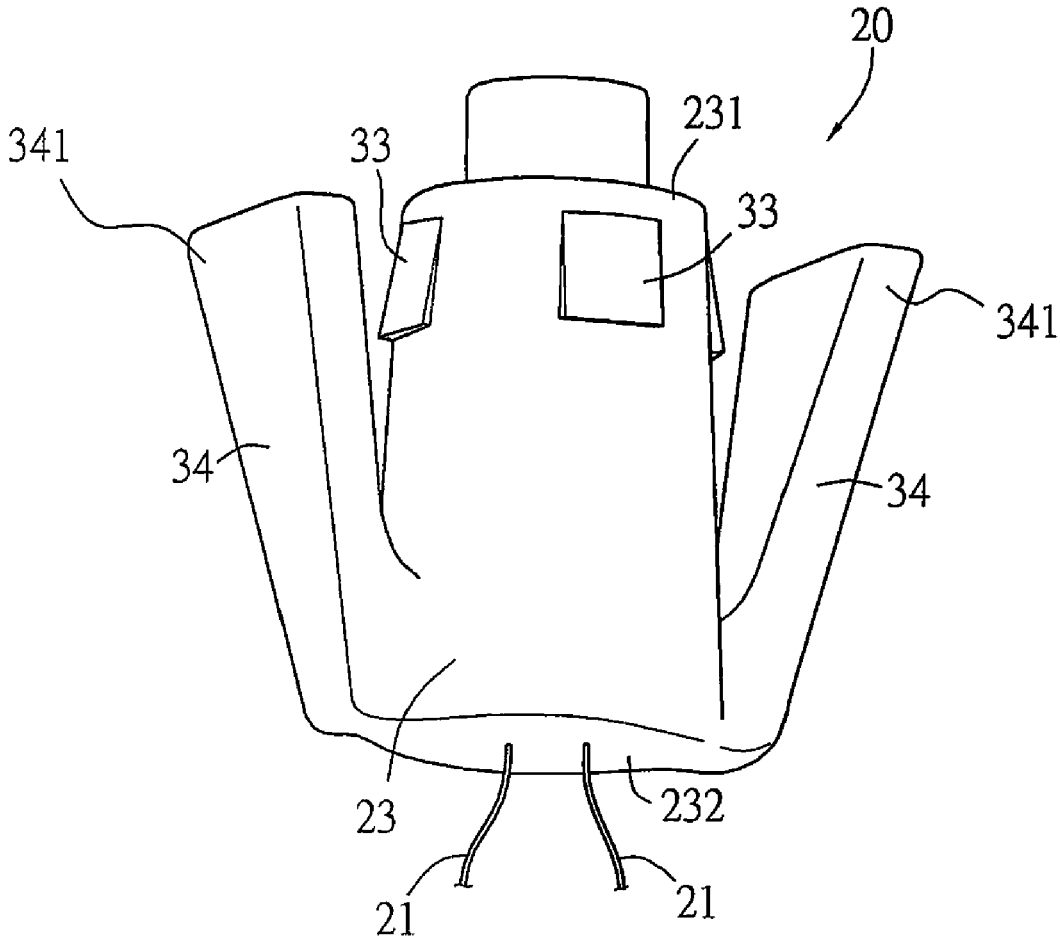
FIG. 6 is a perspective view showing an LED lamp for the waterproof LED lamp holding structure according to a third embodiment of the present invention.
Figure 7:
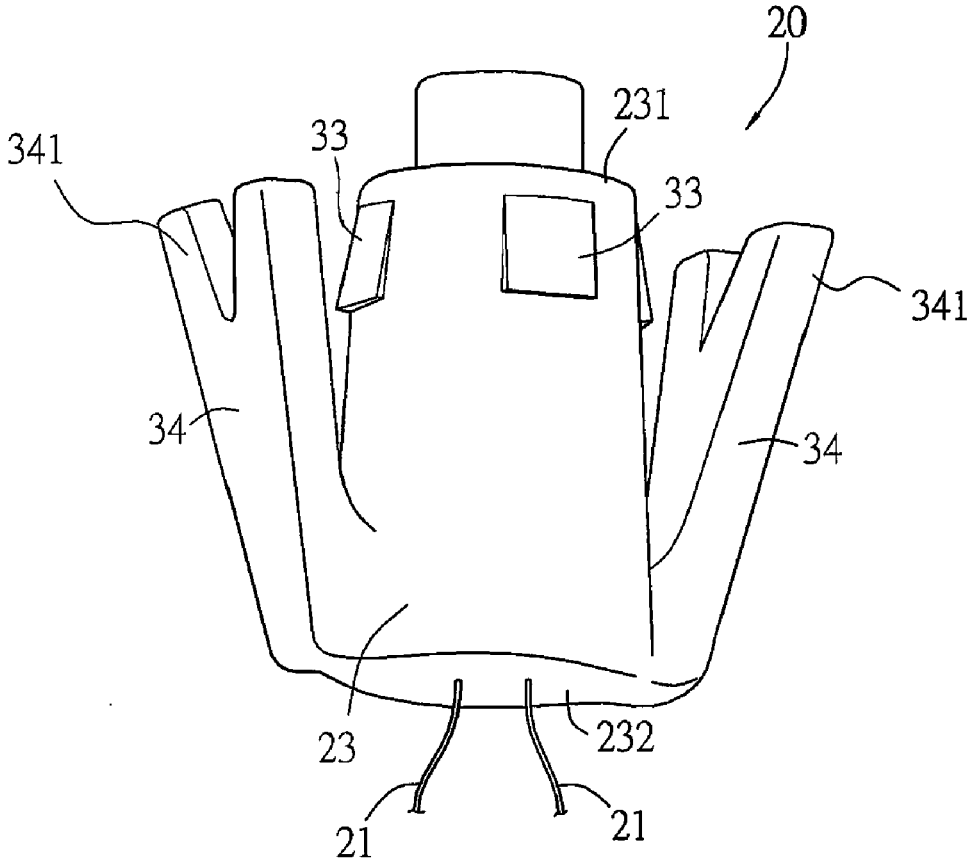
FIG. 7 is a perspective view showing an LED lamp for the waterproof LED lamp holding structure according to a fourth embodiment of the present invention.
Figure 8:
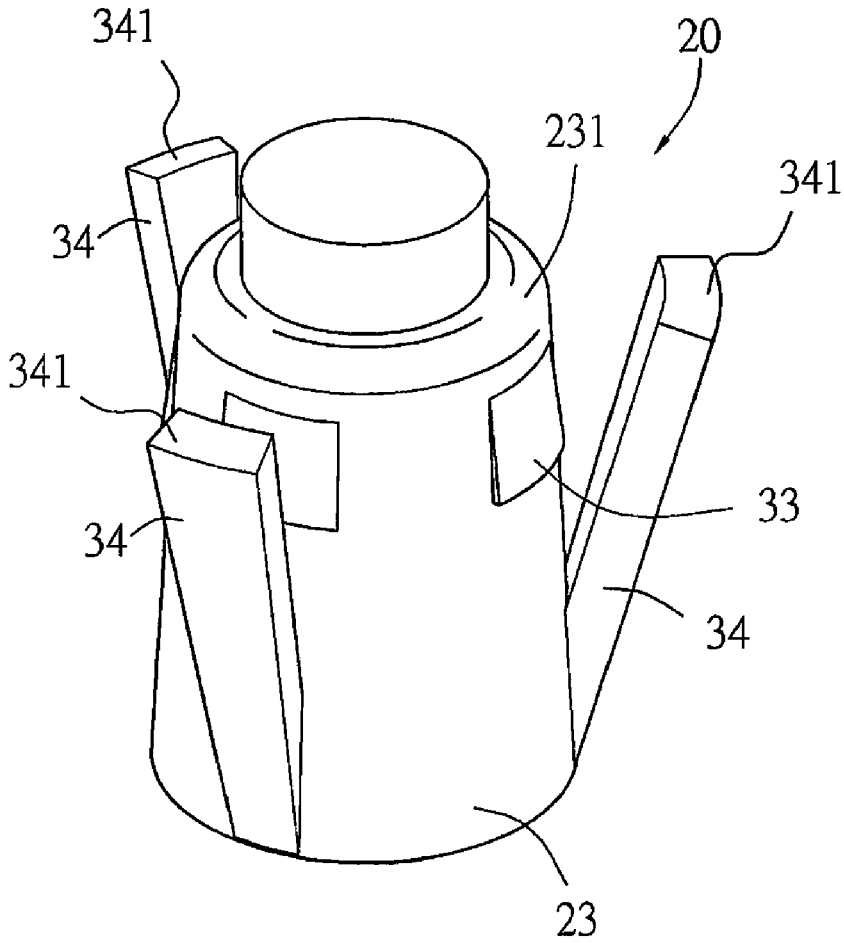
FIG. 8 is a perspective view showing an LED lamp for the waterproof LED lamp holding structure according to a fifth embodiment of the present invention.

Alternatively, the protective member 23 in a third embodiment of the present invention, as shown in FIG. 6, has two diametrically opposite and symmetrical anchoring lugs 34 that have a width gradually increased toward the distal end thereof. Or, in a fourth embodiment of the present invention, the protective member 23 has two diametrically opposite and symmetrical anchoring lugs 34, each of which has a V-shaped distal end as shown in FIG. 7, so as to provide increased contact area between the anchoring lugs 34 and the inner side 32 of the object 10 to ensure immovable and straight holding of the LED lamp 20 in the through hole 11 on the object 10. According to a fifth embodiment of the present invention, as shown in FIG. 8, the protective member 23 is provided on the outer face with three equally spaced anchoring lugs 34 to look like having three claws, which also ensures the LED lamp 20 to be held immovable and straight in the through hole 11 on the object 10.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A waterproof LED lamp holding structure, comprising:

an object showing a geometrical shape and having an outer side and an inner side with a plurality of through holes formed thereon to show geometrical patterns or characters; and at least an LED lamp bank formed from a plurality of LED lamps serially connected via an electric wire, each of the LED lamps having a light-emitting section and a contact pin section, and having a rear part enclosed in a protective member to shield a junction of the contact pin section and the electric wire against external environment; each of the LED lamps being inserted into one of the through holes from the inner side toward the outer side of the object, and being held in the through hole via the protective member with the light-emitting section forward projecting from the outer side of the object;

the waterproof LED lamp holding structure being characterized in that the protective member has a first end closer to the light-emitting end of the LED lamp and a second end opposite to the first end, the light-emitting section of the LED lamp is forward projected from the first end of the protective member, and the electric wire is rearward extended out of the second end of the protective member; and that the protective member is provided on an outer face near the first end with a plurality of wedge-like keys, each of which is extended from near the first end toward the second end with the thickness of the wedge-like key gradually increasing toward the second end; and that the protective member is provided on the outer face near the second end with a plurality of anchoring lugs, which are outwardly obliquely extended from near the second end toward the first end;

whereby when the LED lamp along with the protective member are inserted into the through hole on the object, the wedge-like keys pass through the through hole to abut on the outer side of the object and distal ends of the anchoring lugs abut against the inner side of the object, holding the LED lamp immovable and straight in the through hole on the object.

2. The waterproof LED lamp holding structure as claimed in claim 1, wherein the object is any one of a signboard, an LED illuminator and a decorative lighting fixture having a regular or an irregular configuration, including a bar-shaped object, a designed character, a designed pattern, a spherical object, or a flat plate.

3. The waterproof LED lamp holding structure as claimed in claim 1, wherein the protective member is a substantially cylindrical body, the first end has a cross-sectional area smaller than that of the second end, and the through hole on the object has a size larger than the cross-sectional area of the first end but smaller than the cross-sectional area of the second end of the protective member.

4. The waterproof LED lamp holding structure as claimed in claim 1, wherein the protective member is made of an elastic PVC material.

5. The waterproof LED lamp holding structure as claimed in claim 1, wherein the wedge-like keys with gradually increasing thickness toward the second end each define a slant outer surface for guiding the protective member and accordingly the LED lamp into and through the through hole on the object.

6. The waterproof LED lamp holding structure as claimed in claim 1, wherein the protective member has two diametrically opposite and symmetrical anchoring lugs, and the distal ends of the two anchoring lugs being T-shaped.

7. The waterproof LED lamp holding structure as claimed in claim 1, wherein the protective member has two diametrical opposite and symmetrical anchoring lugs, and the two anchoring lugs each having a width gradually increased toward the distal end thereof.

8. The waterproof LED lamp holding structure as claimed in claim 1, wherein the protective member has two diametrically opposite and symmetrical anchoring lugs, and the distal ends of the two anchoring lugs being V-shaped.

9. The waterproof LED lamp holding structure as claimed in claim 1, wherein the protective member has three equally spaced anchoring lugs to look like having three claws.

10. The waterproof LED lamp holding structure as claimed in claim 1, wherein the anchoring lugs of the protective member each have a length sufficient for the distal ends of the anchoring lugs to fitly abut against the inner side of the object.

11. The waterproof LED lamp holding structure as claimed in claim 1, wherein the anchoring lugs of the protective member have elasticity and have a length sufficient for the distal ends of the anchoring lugs to elastically bend and flatly press against the inner side of the object when the wedge-like keys of the protective member have fully passed the through hole to abut on the outer side of the object.

* * * * *